United States Patent [19]

Nomura

[11] 4,338,680

[45] Jul. 6, 1982

[54] ELECTRONIC TIMEPIECE

[75] Inventor: Yasushi Nomura, Tokorozawa, Japan

[73] Assignee: Citizen Watch Co. Ltd., Tokyo, Japan

[21] Appl. No.: 38,788

[22] Filed: May 14, 1979

Related U.S. Application Data

[63] Continuation of Ser. No. 837,334, Sep. 28, 1977, abandoned.

[30] Foreign Application Priority Data

Sep. 28, 1976 [JP] Japan ..... 51-116441
Sep. 28, 1976 [JP] Japan ..... 51-116442

[51] Int. Cl.[3] ..... G04B 19/24; G04B 25/00; G04C 19/00

[52] U.S. Cl. ..... 368/29; 368/71; 368/72; 368/80; 368/82

[58] Field of Search ..... 58/23 R, 34, 38 R, 38 A, 58/16R, 19 R, 57.5, 85.5, 33, 50 R, 126 R, 127 R, 4 A; 368/69, 70, 71, 72–74, 76, 80, 82, 155, 223, 228, 239, 250, 251

[56] References Cited

U.S. PATENT DOCUMENTS

| | | | |
|---|---|---|---|
| 3,765,163 | 10/1973 | Levine et al. | 58/50 R |
| 3,795,099 | 3/1974 | Tsuruishi | 58/50 R X |
| 3,815,351 | 6/1974 | Vovelle | 58/4 A |
| 3,945,191 | 3/1976 | Van Berkum | 58/4 A |
| 3,948,036 | 4/1976 | Morokawa | 58/23 R |
| 3,962,861 | 6/1976 | Protta et al. | 368/112 X |
| 4,040,248 | 8/1977 | Laesser | 58/57.5 |
| 4,078,376 | 3/1978 | Freeman | 58/50 R X |
| 4,895,486 | 7/1975 | Hammer et al. | 58/85.5 X |

*Primary Examiner*—Vit W. Miska
*Attorney, Agent, or Firm*—Sherman & Shalloway

[57] ABSTRACT

An electronic timepiece which can provide an analog display by a pointer of time information of at least "hour" and "minute" delivered from an electromechanical time keep mechanism and can digitally display by a photoelectric display device a time information set for emitting an alarm and memorized in an alarm memory circuit is disclosed. The electronic timepiece comprises further means for electrically keeping the time information of at least "hour" and "minute", a coincidence detection circuit for detecting a coincidence of the time information delivered from the electrical time keep mechanism with the time information delivered from alarm memory circuit and an alarm emitting device for emitting an alarm signal by a coincidence signal delivered from the coincidence detection circuit.

12 Claims, 12 Drawing Figures

ELECTRONIC TIMEPIECE

This is a continuation, of Application Ser. No. 837,334, filed Sept. 28, 1977, now abandoned.

BACKGROUND OF THE INVENTION

1. Field of the Invention

This invention relates to electronic timepieces and more particularly to an electronic timepiece which can provide an analog display of time by a pointer on the one hand and can digitally display a time set for emitting an alarm by a electrooptical display element or a light transfer element such as a liquid crystal, electrochromism, light emitting diode, etc. on the other hand.

2. Description of the Prior Art

In such kind of timepiece, it has heretofore been required to provide an electromechanical time keep mechanism for keeping a time information such as "hour", "minute" displayed by an analog pointer and an electrical memory circuit for memorizing a time set for emitting an alarm. A difficult problem has heretofore been encountered with measures how to compare and detect the time information of "hour", "minute" and the time set for emitting the alarm.

In order to solve such problem, attempts have been made to provide a mechanism for detecting a pointer position and convert the position thus detected by a mechanoelectrical converter into an electric signal which is then compared with the time set for emitting the alarm, but hitherto none has led to fully satisfactory results owing to the reasons that the detection mechanism is complex in construction and that it is impossible to set the time for emitting the alarm up to 1 minute unit.

In addition, the conventional timepiece has the drawback that if a battery source is exhausted in use and hence the timepiece becomes stopped, both the electromechanical time keep mechanism and the electrical time keep mechanism become out of order.

SUMMARY OF THE INVENTION

A main object of the invention, therefore, is to provide a useful electronic timepiece which can eliminate the above mentioned drawbacks which have been encountered with the prior art techniques.

Another object of the invention is to provide an electronic timepiece which can detect a time set for emitting an alarm in a relatively simple manner.

A further object of the invention is to provide an electronic timepiece in which provision is made of an electrical time keep mechanism which permits to set a time for emitting an alarm to times ranging from 1 to 24 hours.

A still further object of the invention is to provide an electronic timepiece which can set a time for emitting an alarm up to 1 minute unit.

Another object of the invention is to provide an electronic timepiece which can simplify a time correcting mechanism.

In order to attain the above mentioned objects, the invention has a feature of providing in an electronic timepiece which can provide an analog display by a pointer of time information of at least "hour" and "minute" transferred from an electromechanical time keep mechanism and can digitally display by an electro-optical device a time information set for emitting an alarm, the improvement comprising further means for electrically keeping the time information of at least "hour" and "minute", a coincidence detection circuit for detecting a coincidence of the time information delivered from the electrical time keep means with the time information set for emitting the alarm and memorized in an alarm memory circuit and an alarm emitting device for emitting an alarm signal by a coincidence signal delivered from the coincidence detection circuit.

The invention will now be described in greater detail with reference to the accompanying drawings.

DESCRIPTION OF THE PREFERRED EMBODIMENTS

Figures 1A, 2B:
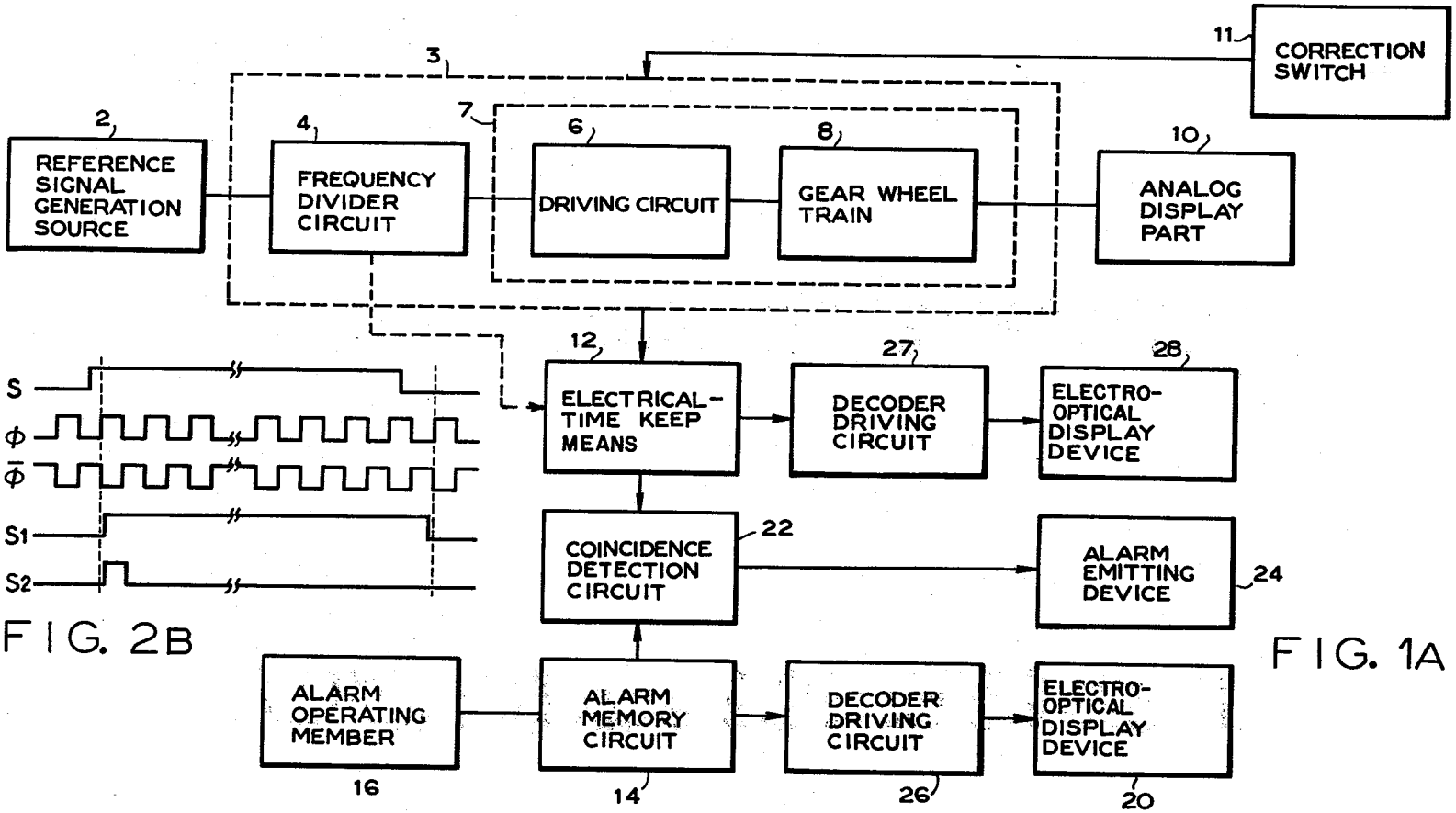
FIG. 1A is a fundamental block diagram of an electronic timepiece according to the invention.

In FIG. 1A is shown one embodiment of an electronic timepiece which can provide an analog display by a pointer with the aid of a pulse motor and can digitally display by a light transmission display device such as a liquid crystal.

Figure 1B:
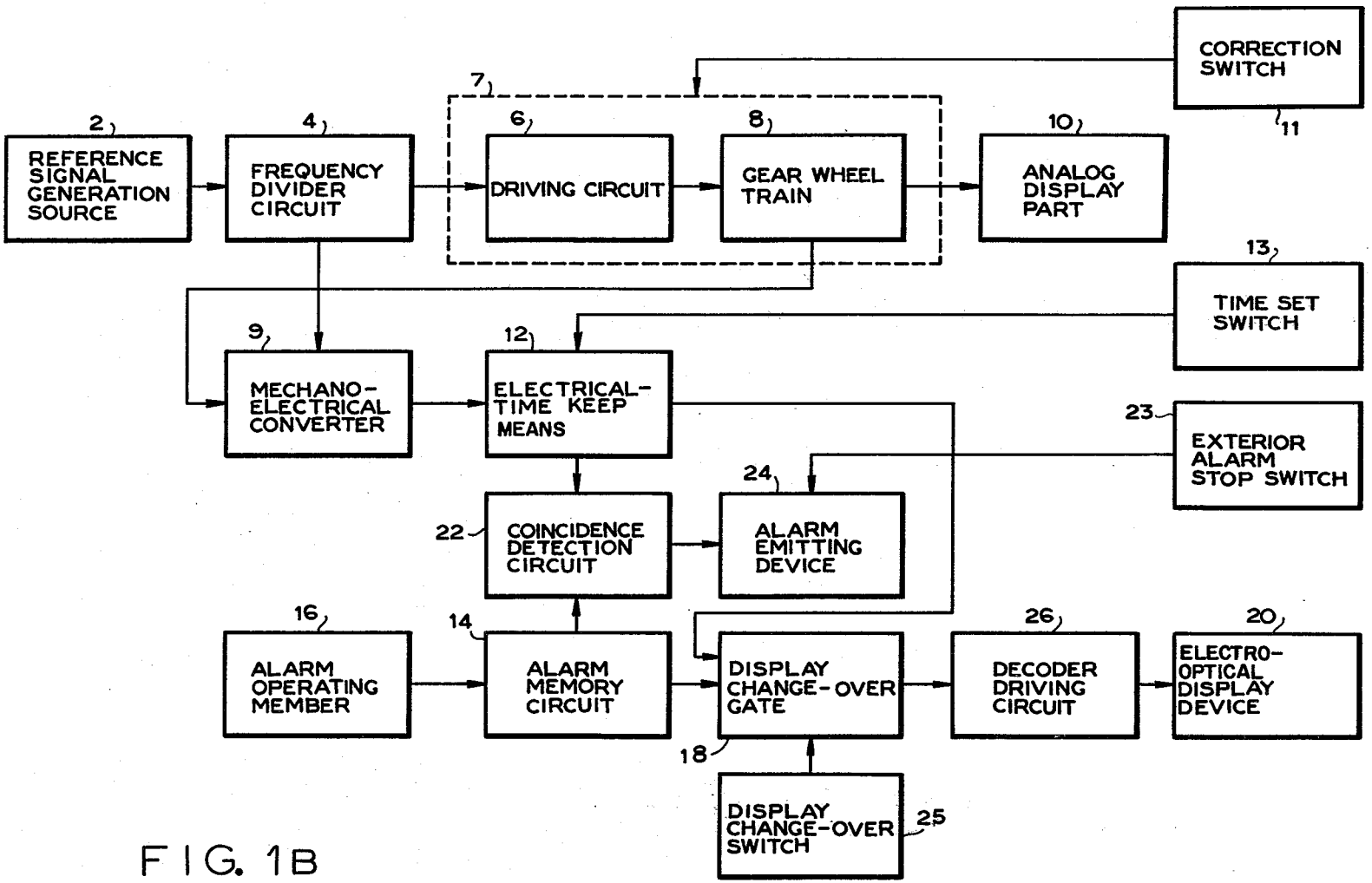
FIG. 1B is a block diagram of one embodiment of an electronic timepiece according to the invention.

In FIGS. 1A and 1B reference numeral 2 designates a reference signal generation source for delivering a reference signal from a crystal oscillator, 3 a time counter mechanism (FIG. 1A), 4 a frequency divider circuit, 6 a driving circuit including a rotor converter, 8 a gear wheel train, and 10 an analog display device including a dial and pointer.

The driving circuit 6 and the gear wheel train 8 constitute an electromechanical time keep mechanism 7.

The output of the time keep means 3 is transmitted to an electrical time keep means 12. For example, the output signal of the frequency divider circuit 4 may be directly received by the electrical time keep means 12 as shown by a dotted line in FIG. 1A.

Reference numeral 9 (FIG. 1B) designates a mechanoelectrical converter for delivering an electrical time signal from the gear wheel train 8 and 12 an electrical time keep means for responding to an output signal from the time keep means to produce an electrical time information signal representative of at least minutes and hours.

Reference numeral 14 designates an alarm memory circuit and 16 an alarm operating means for setting a time for emitting an alarm.

A time information set for the alarm in the alarm memory circuit 14 and a time information kept by the electrical time keep mechanism 12 are compared and detected by a coincidence detector circuit 22. If the time information kept by the electrical time keep mechanism 12 is coincided with the time information kept by the alarm memory circuit 14, a detection signal is delivered from the coincidence detection circuit 22 to an alarm emitting device 24 to cause it to emit an alarm signal. Reference numeral 23 (FIG. 1B) designates an exterior operating switch for stopping the alarm emitting device 24.

The time informations delivered from both the electrical time keep mechanism 12 and the alarm memory circuit 14 are delivered through a display change-over gate 18 (FIG. 1B) and decoder driving circuit 26 to electrooptical display device 20 which is provided on said analogue display surface to display an alarm time information. Reference numeral 25 (FIG. 1B) designates an exterior operating switch for changing over the display on the electro-optical display device 20.

Reference numeral 28 denotes a light transmission device (FIG. 1A) through which the time information is kept by the electrical time keep mechanism 12.

Reference numeral 11 designates a switch for correcting a time kept by the electromechanical time keep mechanism 7, and 13 (FIG. 1B) a switch for setting a time kept by the electrical time keep mechanism 12 to a given value.

In FIG. 2 is shown the relation between the gear wheel train 8 and the mechanoelectrical converter 9 shown in FIG. 1B. In FIG. 3 are shown in detail the electrical time keep mechanism 12, coincidence detection circuit 22 and alarm memory circuit 14 shown in FIGS. 1A and 1B.

In the embodiment shown in FIG. 1B, a signal taken from the reference signal generation device 2, for example, a crystal oscillator, is delivered to the frequency divider circuit 4 which functions to divide the frequency of the signal received to prepare a 1 Hz signal. This 1 Hz signal causes the rotor of the driving circuit 6 to rotate. The gear wheel train 8 functions to mechanically divide the frequency of the 1 Hz signal so as to display "hour" and "minute" in the analog display part 10 with the aid of the dial and pointer.

Figure 2A:
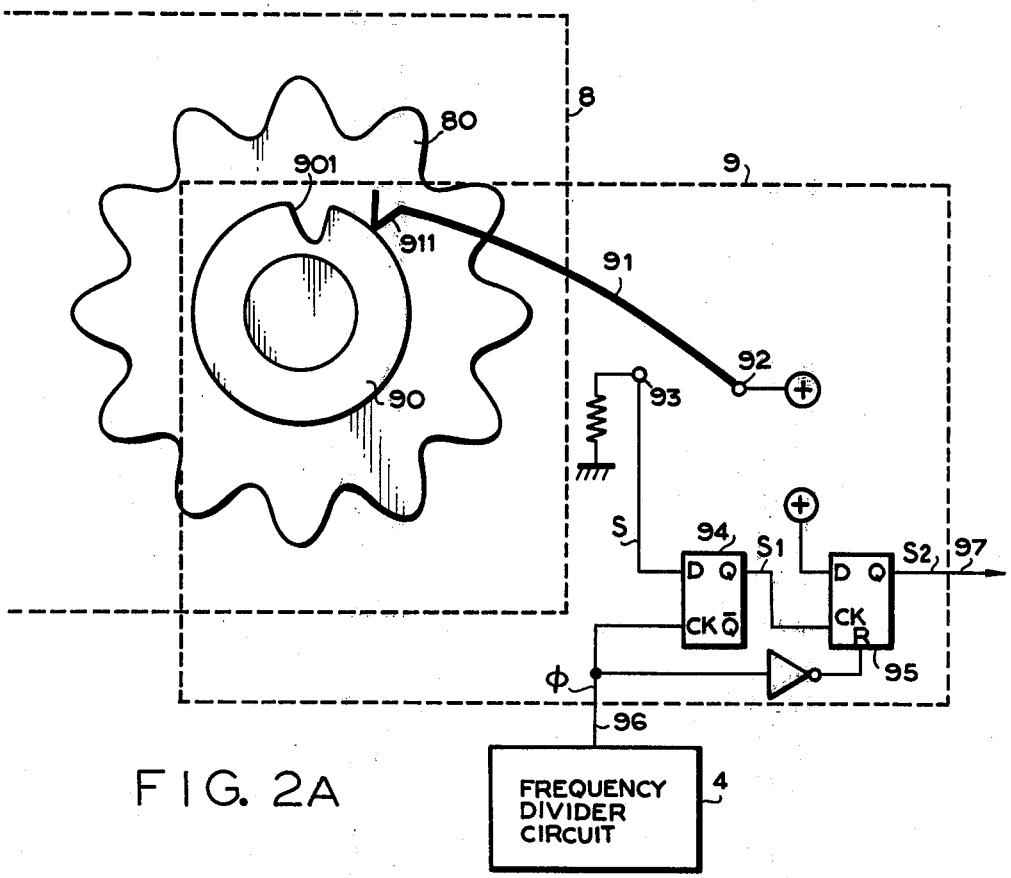
FIG. 2A schematically illustrate mainly the relation between a gear wheel train and a mechanoelectrical converter shown in FIGS. 1B and 2B waveforms thereof respectively.
Figure 3:
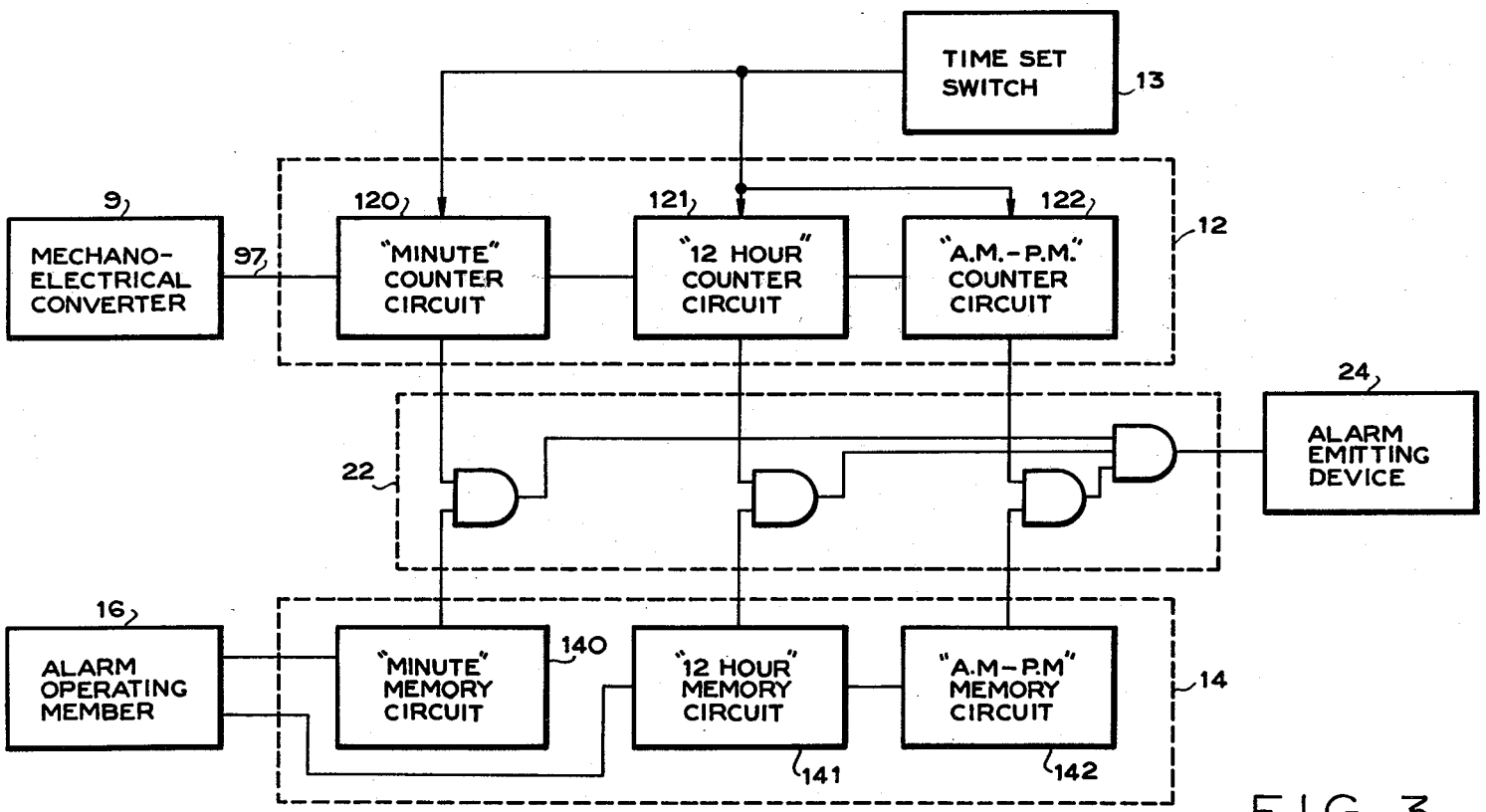
FIG. 3 is a block diagram mainly showing in detail an electrical time keep mechanism, coincidence detection circuit, and alarm memory circuit shown in FIG. 1B.

As shown in FIG. 2A, the gear wheel train 8 is provided coaxially with its fourth wheel 80 (which is a second pointer wheel when it is provided with a pointer) with a cam 90 with a notch 901 formed on the periphery thereof. The mechanoelectrical converter 9 is provided with a spring contact 91 having one end connected to a plus contact 92 having an "H" level. A free end 911 of the spring contact 91 is adapted to be dropped into the notch 901 every time the fourth wheel 80 is rotated one turn so as to bring the spring contact 91 into contact with a contact 93 connected to ground and through a chattering eliminating flipflop 94, flipflop 95 for preparing a narrow pulse signal and line 97 to the electrical time keep mechanism 12, thereby delivering an input signal as a "minute" time signal to the electrical time keep mechanism 12 one time for every one minute. Reference numeral 96 designates a line for supplying a frequency divided signal from the frequency divider circuit 4 to the mechanoelectrical converter 9.

Referring to FIG. 2B there will be described to understand the structure of FIG. 2A in greater detail. FIG. 2B shows waveforms of FIG. 2A in which reference S depicts a signal at the contact 93, $S_1$ an output from the terminal Q of the flipflop 94, $S_2$ an output from the terminal Q of the flipflop 95 and $\phi$ a signal delivered through the frequency divider circuit.

As shown in FIG. 3, the "minute" time signal is supplied from the mechanoelectrical converter 9 through the line 97 to a "minute" counter circuit 120 of the electrical time keep mechanism 12 which functions to keep a "minute" time information. An "hour" time signal delivered from the "minute" counter circuit 120 causes an "hour" counter circuit 121 to operate so as to keep an "hour" time information. A "12 hour" time signal delivered from the "hour" counter circuit 121 causes an "a.m.-p.m." counter circuit 122 to operate so as to keep an "a.m.-p.m." time information.

The time kept by the electrical time keep mechanism 12 is based on the "minute" time signal delivered from the fourth wheel 80 of the gear wheel train 8, so that there is no risk of the time kept by the electrical time keep mechanism 12 being rendered out of order on the course of the operation of the timepiece if it is made coincident beforehand with the time kept by the electromechanical time keep mechanism 7.

For this purpose, the times set by an alarm "minute" memory circuit 140, alarm "hour" memory circuit 141 and "a.m.-p.m." memory circuit 142 and the corresponding times set by the electrical time keep mechanism 12 are compared and detected by the coincidence detection circuit 22.

Figures 4, 9:
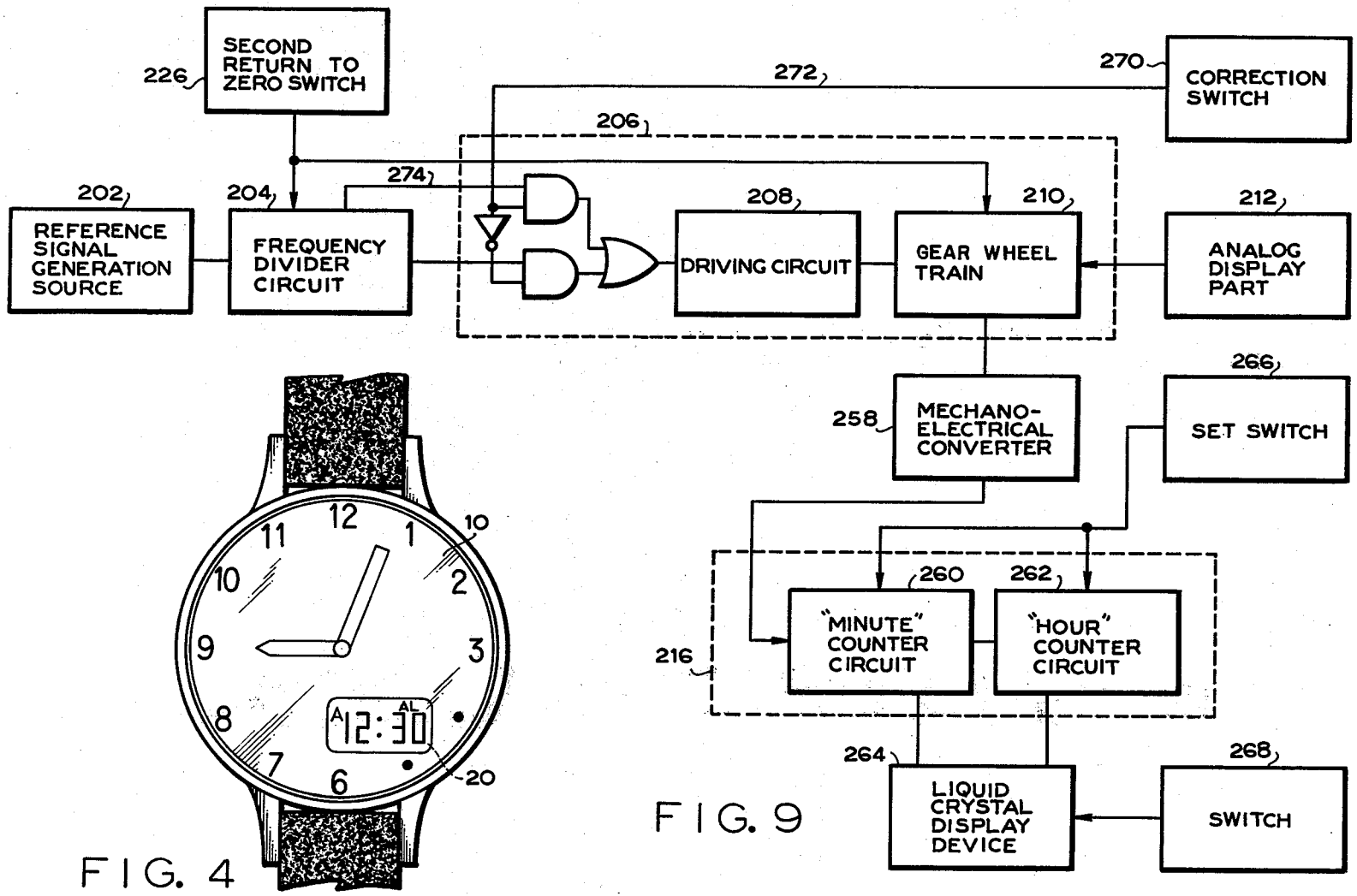
FIG. 4 is a front elevational view of the electronic timepiece shown in FIG. 1B.
FIG. 9 is a block diagram of a still further embodiment of an electronic timepiece according to the invention.

In FIG. 4 is shown one example of the display of the electronic timepiece constructed and arranged as described above according to the invention. The light transmission display device 20 is set to display the alarm at 12:30 a.m. The alarm is emitted when the pointer arrives at just 12:30 a.m. There is no discrepancy between the time displayed by the pointer and the time set for emitting the alarm information.

The time kept by the electromechanical time keep mechanism 7 may be made coincident at the first time with the time kept by the electrical time keep mechanism 12 by the use of the following measures in the case of fitting the pointer to the timepiece.

(1) Prior to fitting the pointer to the timepiece, a fast feed signal is supplied from the switch 11 to the driving circuit 6 so as to rotate the gear wheel train 8 at a higher speed. Alternatively, gear wheels following to the fourth wheel 80 of the gear wheel train 8 may be rotated.

(2) The time information delivered from the electrical time keep mechanism 12 is displayed by the photoelectric display device 20 with the aid of a display change-over switch 25. In order to omit the above described measure, the switch 11 may be changed over so as to effect the above described change-over operation.

(3) When "minute" electrooptically displayed after correction of the gear wheel train 8 is advanced one place, the switch 11 is set to its OFF position so as to locate the minute pointer and hour pointer at position of 12:00 respectively.

(4) The time kept by the electrical time keep mechanism 12 is reset to 12:00 by one touch with the aid of the switch 13.

If the battery is exhausted in use, a new battery is enclosed in the timepiece and then the analog display is corrected by the switch 11 to 12:00. Subsequently the above described operation (4) is effected and then the switch 11 is operated to set the time kept by the electrical time keep mechanism 12 to a given time.

The switch 11 functions to deliver a fast feed signal instead of the 1 Hz signal to the gear wheel train 8, and as a result, the rotation of the fourth wheel 80 becomes faster, thereby correcting the time information kept by both the electromechanical time keep mechanism 7 and the electrical time keep mechanism 12.

In a system of correcting times shorter than second and "hour", "minute" independently from each other by means of the switch 11 as in the case of a conventional step motor driven analog pointer timepiece, the following successive steps are taken.

(1) When the spring contact 91 is dropped into the notch 901 of the cam 90, the hour pointer and minute pointer are fitted to the position of 12:00.

(2) The times shorter than second are stopped by the switch 11 and then the timepiece is set to a given time.

(3) The time kept by the electrical time keep mechanism 12 is also set to the given time by means of the switch 13.

(4) The times shorter than second are started.

As a result, the timepiece must be constructed such that the time kept by the electrical time keep mechanism 12 can be corrected by means of the switch 13.

Figure 5A:
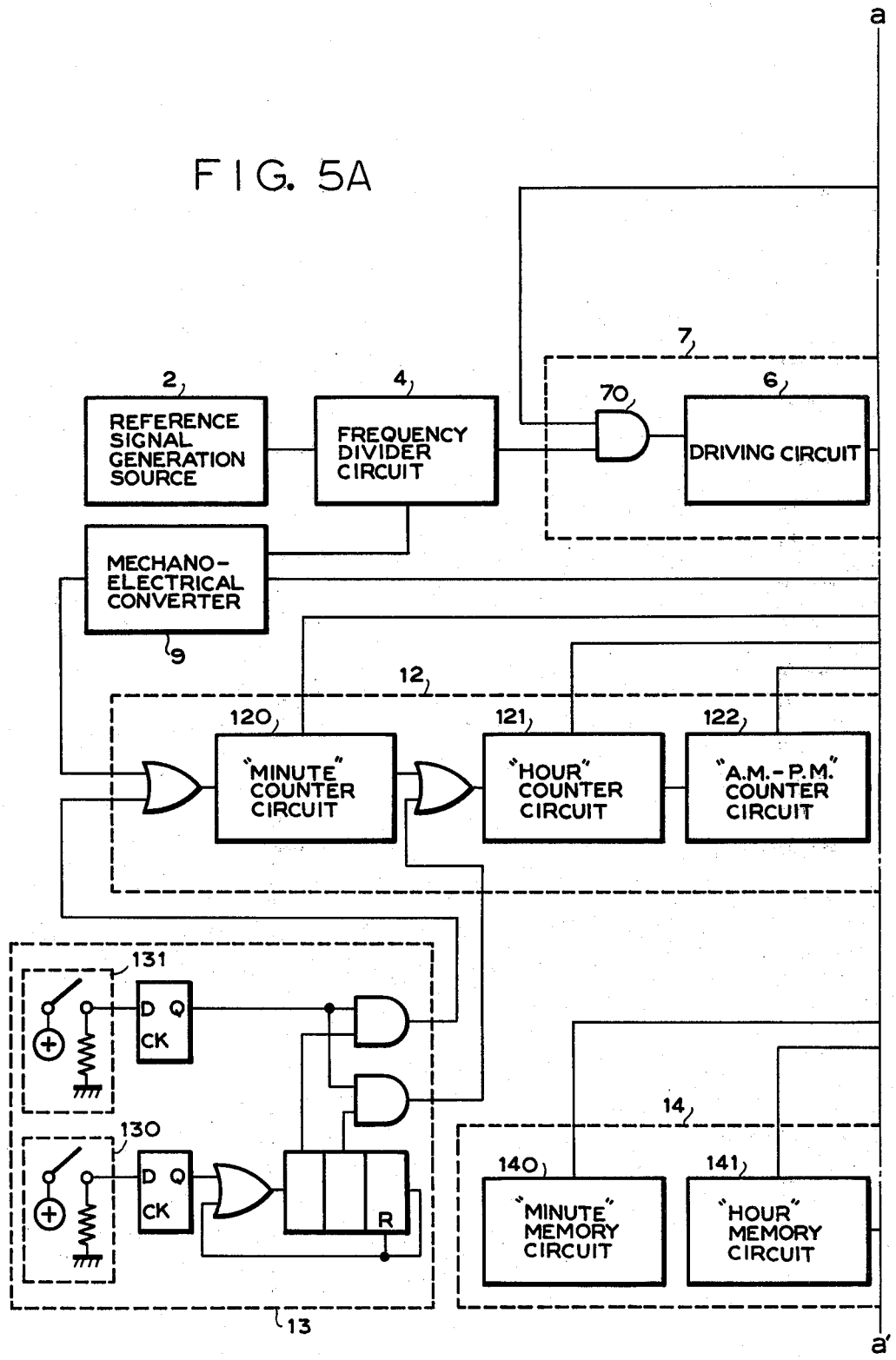
FIGS. 5A and 5B are a detailed block diagram of a modified embodiment of the electronic timepiece shown in FIG. 1B.
Figure 5B:
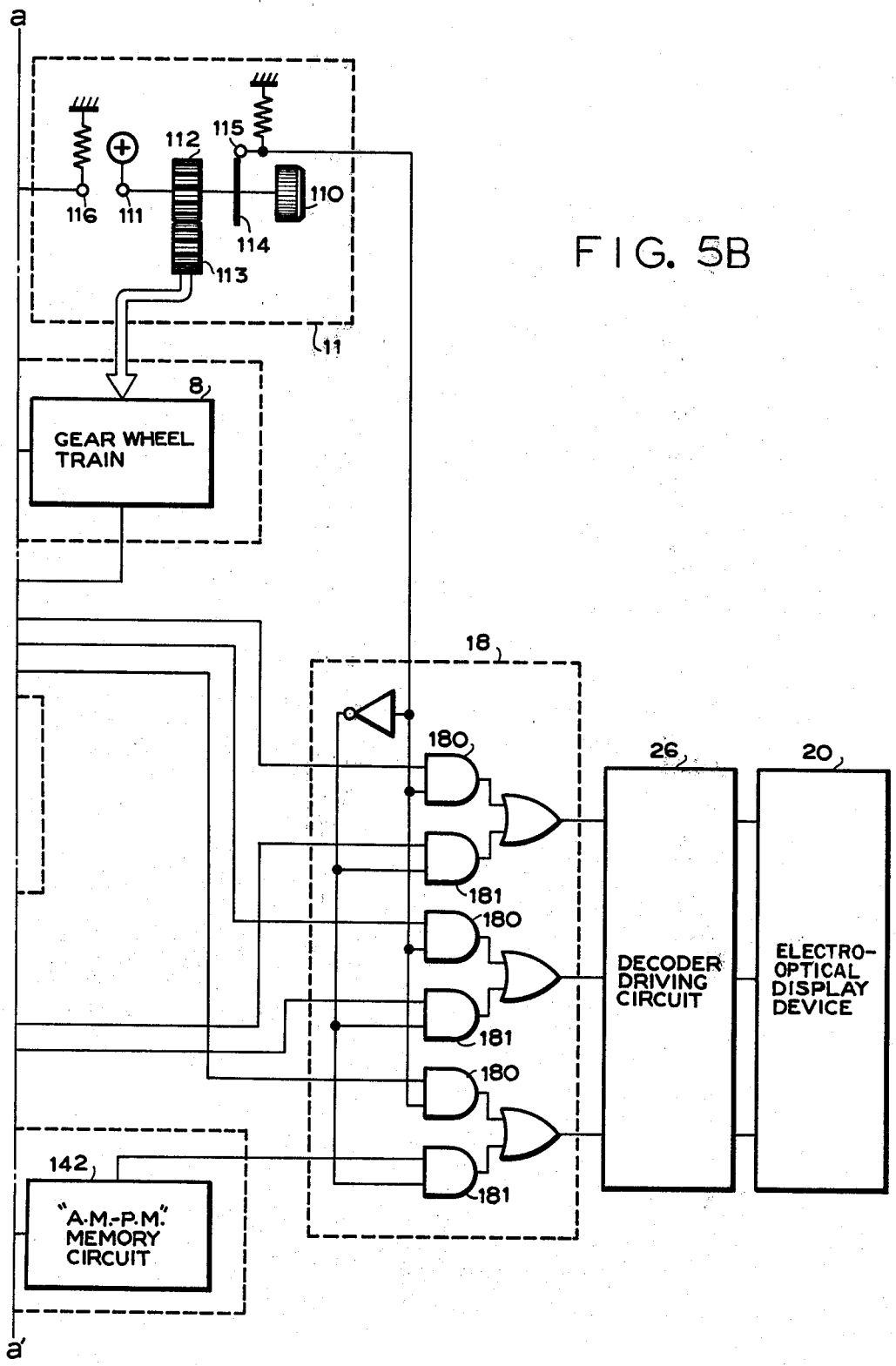

In FIGS. 5*a* and 5B is shown another embodiment of the timepiece so constructed as above described. In FIG. 5, the same reference numerals designate various parts which are the same as those shown in FIGS. 1A, 1B and 3.

In the present embodiment, the switch 11 is composed of a winding crown switch 110 which can be rotated both in clockwise and counter clockwise directions at a position when the switch 11 is pulled in one step. When the winding crown 110 is pushed, a contact 111 makes contact with a contact 116 to open an AND gate 70 provided in the electromechanical time keep mechanism 7. As a result, the 1 Hz signal is supplied from the frequency divider circuit 4 to the driving circuit 6. When the winding crown switch 110 is pulled one step, the contact 111 is separated from the contact 116 to close the AND gate 70, thereby stopping the 1 Hz signal to be supplied to the driving circuit 6.

When the winding crown switch 110 is pulled one step, a contact 114 makes contact with a contact 115 to make an AND gate 180 of the display change-over gate 18 open and make an AND gate 181 thereof close, thereby displaying the time information kept by the electrical time keep mechanism 12 by the light transmission display device 20. In addition, when the winding crown switch 110 is pulled one step, a gear 112 secured thereto becomes geared with a transfer gear 113 which is geared with a minute pointer wheel of the gear wheel train 8. As a result, the time to be displayed by the analog pointer can be corrected by rotating the winding crown switch 110.

The switch 13 is provided therein with a select switch 130 and a set switch 131. The select switch 130 functions to select either one of the "minute" counter circuit 120 and the "hour" counter circuit 121 to be corrected. The set switch 131 functions to correct the counter circuit thus selected to a given time. In other words, the embodiment shown in FIGS. 5A and 5B is constructed such that the analog displaying hour pointer and minute pointer can be corrected independently from each other, that is, the electromechanical time keep mechanism 7 can solely be corrected. As a result, it is also possible to solely correct the electrical time keep mechanism 12 by means of the switch 13. Thus, the timepiece can be started after the time informations kept by the respective time keep mechanisms have been set and made coincident with the given time and then the winding crown switch 110 is pushed to its predetermined position.

Figure 6:
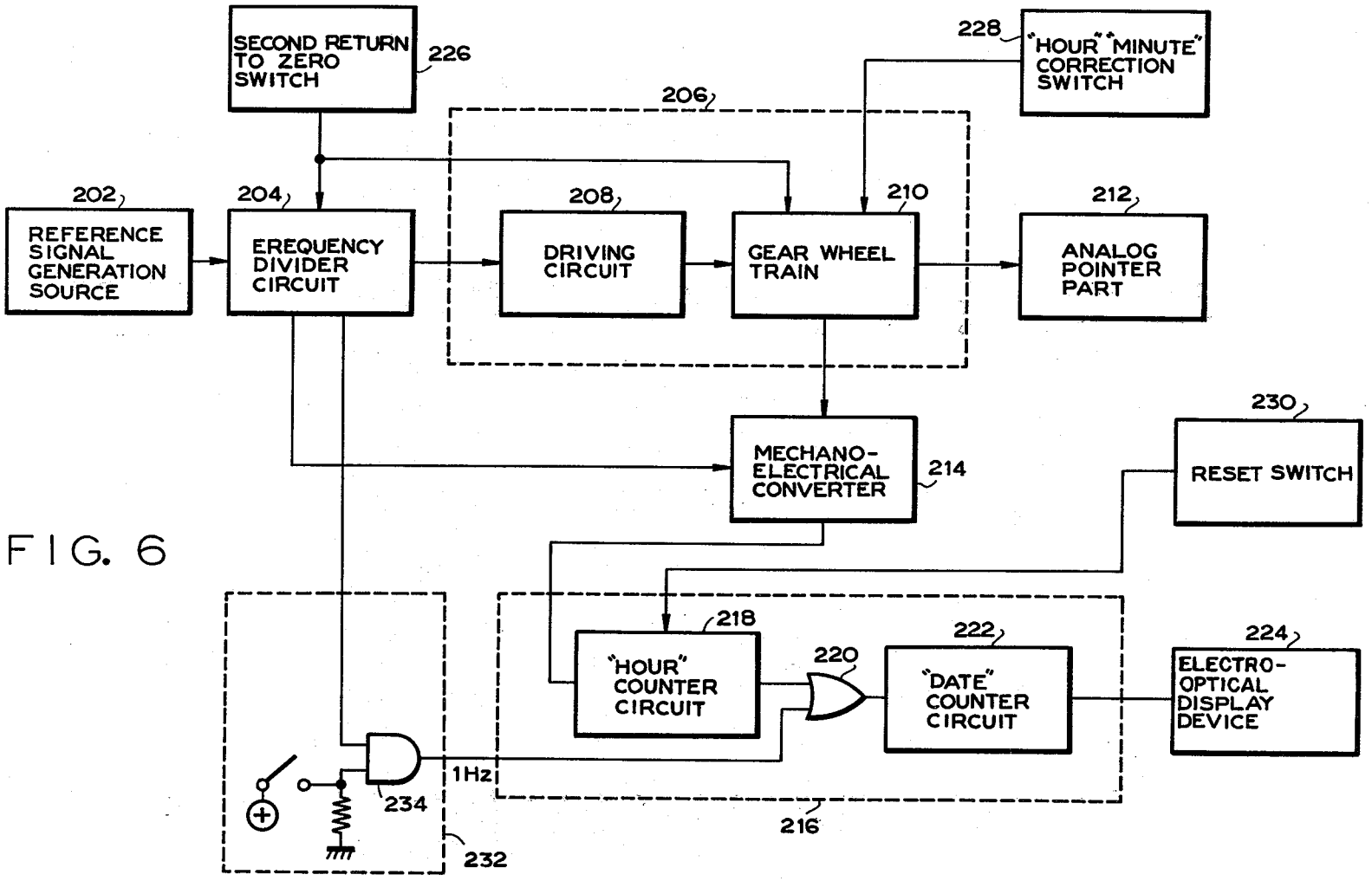
FIG. 6 is a block diagram of a further embodiment of an electronic timepiece according to the invention.

In FIG. 6 is shown a further embodiment of an electronic timepiece according to the invention. In FIG. 6, reference numeral 202 designates a reference signal generation device, 204 a frequency divider, 206 an electromechanical time keep mechanism to be operated by a time reference signal delivered from the frequency divider 204 and composed of a driving circuit 208 including a rotor converter adapted to be rotated by one turn every 1 second and a gear wheel train 210. Reference numeral 212 designates an analog pointer display part composed of a dial displaying a time kept by the electromechanical time keep mechanism 206 and a pointer.

Figure 7:
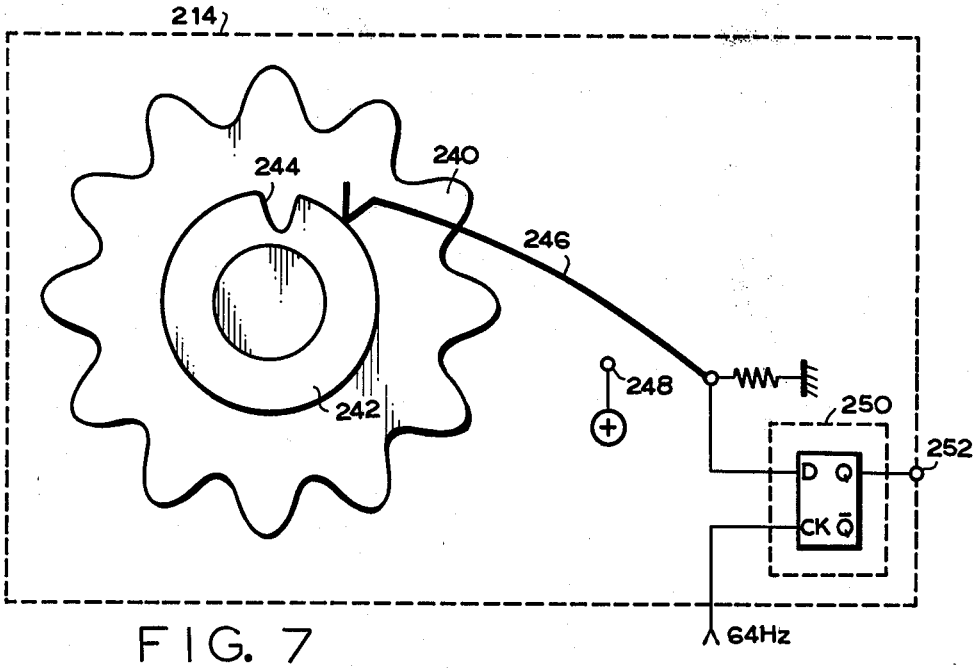
FIG. 7 schematically illustrates mainly the relation between the gear wheel train and the mechanoelectrical converter shown in FIG. 6.

Reference numeral 214 designates a mechanoelectrical converter for taking out an "hour" time signal from a minute pointer wheel of the gear wheel train 210 and constructed as shown in FIG. 7. To a second wheel 240 of the gear wheel train 210 is secured a cam 242 which is rotated one turn every 1 hour and provided at its periphery with a notch 244. When the cam 242 is rotated one turn, a spring switch 246 is dropped into the notch 244 to make the spring switch 246 in contact with a plus contact 248 to supply one pulse every 1 hour through a chattering eliminating circuit 252 to an output end 252. This "hour" time signal is transferred to an "hour" counter circuit 218 of the electrical time keep mechanism 216 and kept therein.

Figure 8:
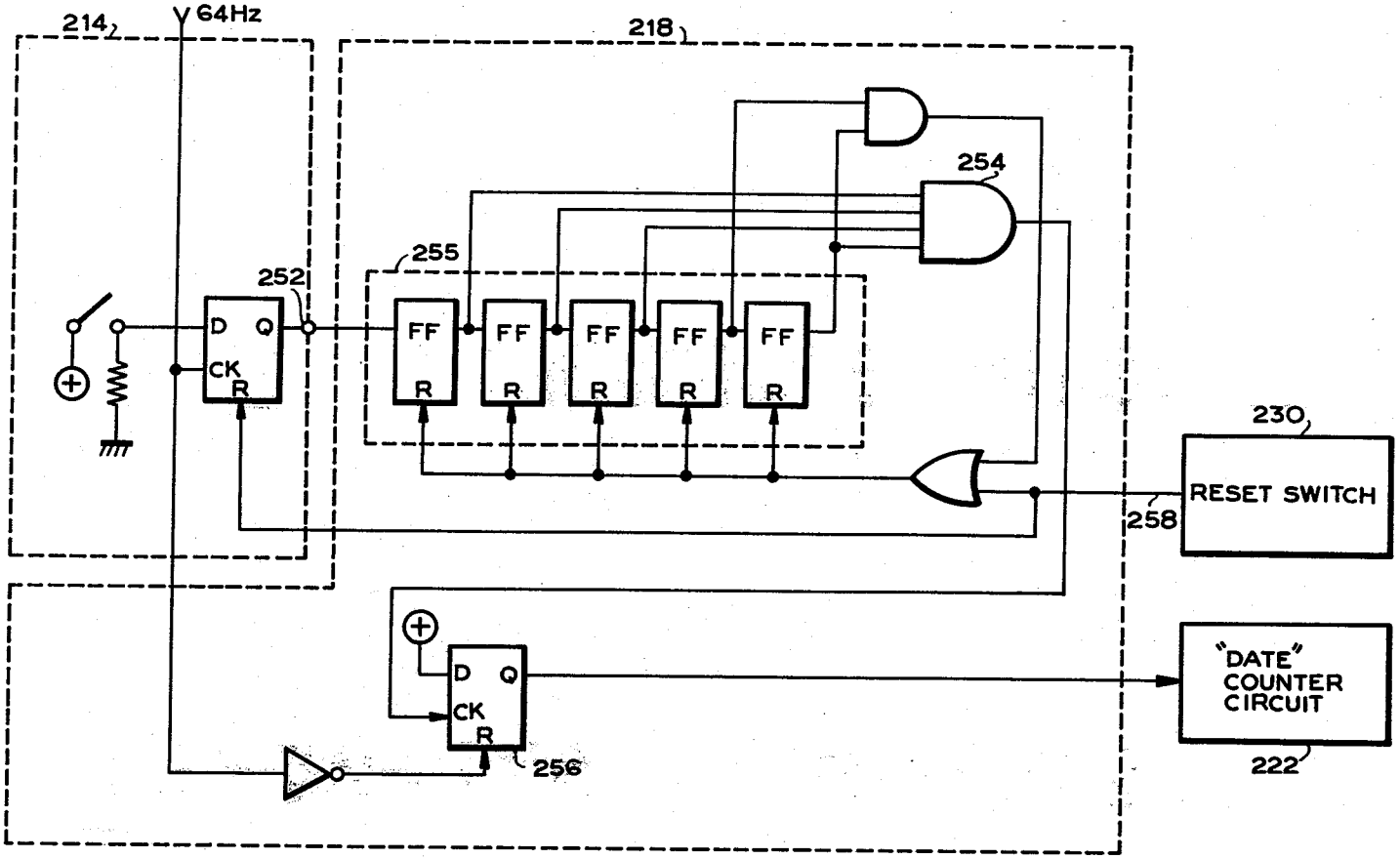
FIG. 8 is a schematic diagram showing in detail one example of the mechanoelectrical converter and the "hour" counter circuit shown in FIG. 6.

In FIG. 8 is shown one example of the mechanoelectrical converter 214 and "hour" counter circuit 218 shown in FIG. 6. The "hour" counter circuit 218 is composed of five stages of flipflops 255. When the "hour" time signal is delivered to the "hour" counter circuit 218, an output from an AND gate 254 becomes "H" and hence a data type flipflop 256 functions to deliver a narrow pulse signal one time every one day as a "date" time signal. The "date" time signal is supplied through an OR gate 220 to a "date" counter circuit 222 which functions to keep the "date" time.

The "date" time information is digitally displayed at a light transmission display device 224. In other words, in the present embodiment, the "hour", "minute", "second" or "hour", "minute" are displayed by the analog pointer and the "date" is displayed by the photoelectric display device 224.

In FIG. 6, reference numerals 226, 228, 230 and 232 designate switches for controlling the electronic timepiece. The switch 226 is a second return to zero switch which functions to reset a portion of the frequency divider circuit 204 and control the gear wheel train 210 so as to cause the second pointer to return to zero. The switch 228 is a switch which functions to control "hour" and "minute" and set the pointer to a given position with the aid of a gear wheel train provided at the back of the timepiece in the same manner as the conventional timepiece.

The switch 232 is a switch for correcting the date. If the switch 232 is closed, an AND gate 234 becomes open to deliver the 1 Hz signal through the OR gate 220 in the electrical time keep mechanism 216 to the "date" counter circuit 222, thereby correcting the date by changing the day at one second intervals.

The switch 230 is a switch for resetting the "hour" counter circuit 218 in the electrical time keep mechanism 216.

In the present embodiment, the electrical time keep mechanism 216 functions to keep the "hour" time with the aid of an hour pointer wheel geared with a minute pointer wheel in the gear wheel train 210 and at the same time to keep the "hour" time with the aid of the "hour" counter circuit 218.

As a result, it is necessary to make coincident the time kept by the hour pointer with the time kept by the "hour" counter circuit 218. In the present embodiment, the time signal delivered from the gear wheel train 210 is mechanoelectrically converted, so that the above coincidence in time is effected at the initial condition. Once the time coincidence is effected, the change of the gear wheel train 210 results in the change of the "hour" counter circuit.

As seen from FIG. 8, if the reset switch 230 is operated, its output is supplied through a line 258 to the flipflop 255 so as to reset it and make the time kept by it 0 hour. As a result, the above described coincidence in time may be effected by the following successive steps.

(1) The switch 228 is operated to cause the gear wheel train 210 to operate. When the date becomes changed, the gear wheel train 210 is stopped and then the hour pointer and minute pointer are fitted to a position of 12 hour: 0 minute.

(2) The switch 230 is operated to reset the flipflop 225.

Such coincidence in time is taken when the timepiece is shipped from a manufacturer.

If the battery is exhausted in use of the timepiece to cause it to stop, the above described coincidence in time may be effected by the following successive steps.

(1) A new battery is incorporated into the timepiece and then the switch 228 is operated to set the hour pointer and minute pointer to 12 hour: x minute (x=0 to 59).

(2) The switch 230 is operated to reset the flipflop 255.

(3) The hour pointer and minute pointer are set to a given time with the aid of both the switch 228 and the switch 226. (It is possible to set the date without operating the switch 232).

As stated hereinbefore, in an electronic timepiece adapted to simultaneously keep the same time information by an electromechanical time keep mechanism and by an electrical time keep mechanism, provision of means for taking up a time signal from the electromechanical time keep mechanism and electrically keeping it and for controlling and setting a time kept by the electrical time keep mechanism to a given time renders it possible to effect coincidence in time with the aid of an extremely simple construction in an easy and reliable manner.

The invention is described with reference to an electronic timepiece for displaying "hour" and "minute" or "hour", "minute" and "second" by an analog pointer and for displaying "date". The invention may also be applied, for example, to an electronic timepiece for displaying the "hour" and "minute" by both the analog pointer and the liquid crystal and to an electronic timepiece for keeping the "hour" and "minute" by the electrical time keep mechanism and detecting a coincidence of the "hour" and "minute" thus kept with a time set for alarm, etc.

In FIG. 9 is shown a still further embodiment of an electronic timepiece for displaying the "hour" and "minute" by both the analog pointer and the liquid crystal.

In FIG. 9, the same reference numerals designate the same mechanism, circuit, switch and member as those shown in FIG. 6.

In the present embodiment, use is made of an electromechanical time keep mechanism 210 which is the same as the gear wheel train 210 shown in FIG. 6. In order to take up a "minute" time signal from the electromechanical time keep mechanism 210, in a mechanoelectrical converter 258, to the second pointer wheel in the gear wheel train 210 is secured a cam. One pulse is delivered from the mechanoelectrical converter 258 every one minute, that is, when the cam is rotated one turn. For this purpose, use may be made of a second pointer wheel instead of the minute pointer wheel shown in FIG. 7.

The "minute" time signal is transferred to a "minute" counter circuit 260 which functions to keep it. From the "minute" counter circuit 260 is transferred an "hour" time signal to an "hour" counter circuit 262 which functions to keep it. A switch 268 is operated to display the "minute" and "hour" time signals thus kept by a liquid crystal display device 264.

In FIG. 9, reference numeral 266 designates a switch for setting the "minute" counter circuit 260 and "hour" counter circuit 262 to a given time, for example, to 0 hour: 0 minute a.m.

The time is corrected under the normal condition as follows. If a switch 270 is operated to make a line 272 "H" level, a fast feed signal is delivered from a frequency divider circuit 204 through a line 274 to a driving circuit 208. As a result, the second pointer wheel is rotated at a speed of 64 turns per 1 second so as to correct the hour pointer and minute pointer and at the same time correct the "minute" counter circuit 260 and "hour" counter circuit 262. If a battery is exhausted to stop the timepiece, the switch 270 is operated to correct the hour pointer and minute pointer to 12 hour: 0 minute and then the switch 266 is operated to set the "minute" counter circuit 260 and "hour" counter circuit 262 to 0 hour: 0 minute a.m.

This means that coincidence in time is effected so that the switch 270 is operated to correct the time to a correct time. The correction switch 270 constructed as above described may also be used for the purpose of correcting the electrical time keep mechanism 216. As a result, the present embodiment provides an electronic timepiece which requires a small number of switch operating members and can effect the coincidence in time in a simple manner.

In the embodiments shown in FIGS. 6 and 9, the time is set to 12 hour or to 12 hour: 0 minute with the aid of the switch 230 or the switch 270. But, such time thus set is only one example. It is a matter of course that the time may be set to any other given times and the pointers may be set to such given times. In such case, the time kept by the electrical time keep mechanism can be set to a given value by only one touch or by a simple operation which is substantially one touch.

If the group of flipflops 225 shown in FIG. 8 is composed of a set-reset type flipflop, the switch 230 may be operated so as to set the first and third flipflops and reset the second and fourth flipflops. In this case, the time may be set to 6 hour with the aid of the switch 230.

As explained hereinbefore with reference to FIG. 1B, for example, the use of measures described for making the time information kept by the electromechanical time keep mechanism 7 coincident with the time information kept by the electrical time keep mechanism 12 and for comparing and detecting the coincidence between the time kept by the electrical time keep mechanism 12 and the alarm emitting time set by the alarm memory circuit 14 and hence giving the alarm information ensures the provision of an electronic timepiece according to the invention having the following advantages.

(1) The comparison between the alarm emitting time and the time kept by the electrical time keep mechanism and detection of the alarm information can simply be effected.

(2) The use of the electrical time keep mechanism ensures a set of times ranging from 1 hour to 24 hour.

(3) The alarm signal can be set up to 1 minute unit.

The invention is not limited to the embodiments described above, but various modifications and alternations may be made. For example, the invention may be applied to electronic timepieces incorporated with or replaced by a number of conventional alarm setting abilities capable of temporarily, daily emitting alarm, emitting multiple alarms, emitting alarm at "date", "hour", "minute", by a simplified switch, by various kinds of switches such as a push-button switch, slide switch, etc.

In addition, the invention is capable of effecting the coincidence in time, in the case of keeping the same time information by both the electromechanical time keep mechanism and the electrical time keep mechanism, by a mechanism which is simple in construction and easy and reliable in operation and at the same time of simplifying the time correcting mechanism.

What is claimed is:

1. An electronic timepiece comprising:

(a) a time reference signal generation source for generating a time reference signal;

(b) time keep means for processing the time reference signal to synthesize a driving signal, said time keep means including a gear wheel train which keeps the time;

said time keep means comprising a frequency divider circuit connected to said time reference signal generation source, a driving circuit receiving an output signal from said frequency divider circuit, said gear wheel train receiving a signal from said driving circuit and keeping the time information;

(c) analogue display means for displaying at least hours and minutes by means of hands and dial plate connected with said gear wheel train;

(d) electrical time keep means for receiving an output signal from said time keep means and for keeping a time information of at least hours and minutes;

said electrical time keep means converting the time information kept by said gear wheel train into an electrical signal;

(e) external alarm actuating means for providing an alarm time information of at least hours and minutes;

(f) an alarm memory circuit for receiving and storing the alarm time information provided by said external alarm actuating means;

(g) a coincidence detection circuit connected to said alarm memory circuit and to said electrical time keep means respectively, and receiving and comparing the alarm time information signal stored in said alarm memory circuit and the time information signal kept by said electrical time keep means detecting a coincidence thereof so as to transmit an alarm signal;

(h) an alarm emitting device emitting an alarm by the alarm signal from said coincidence detection circuit;

(i) alarm digital display means connected to said alarm memory circuit and provided at the part of a display area of said analogue display means for digitally displaying the alarm time information stored in said alarm memory circuit; and (j) means for converting said electrical signal to a digital display corresponding to said time information kept by the gear wheel train.

2. The electronic timepiece according to claim 1 wherein said converting means (j) comprises display change-over means connected to said electrical time keep means and said alarm memory circuit respectively for selectively transmitting the time information of said electrical time keep means and the alarm time information of said alarm memory circuit to said alarm digital display means so as to display the time information or the alarm time information, and a decoder driving circuit connected between said display change-over means and said alarm digital display means.

3. The electronic timepiece according to claim 1 further comprising a time setting switch connected to said electrical time keep means for setting the kept time of said electrical time keep means.

4. The electronic time piece according to claim 1 which further comprises a mechano-electrical converter between said gear wheel train and said electrical time keep means.

5. The electronic time piece according to claim 1 wherein said electrical time keep means receives said output signal directly from said time keep means and wherein said converting means (j) comprises digital display means for digitally displaying the time information kept by said electrical time keep means through a decoder driving circuit.

6. An electronic timepiece comprising:

(a) a time reference signal generation source for generating a time reference signal;

(b) time keep means for processing the time reference signal to synthesize a driving signal, said time keep means including a gear wheel train which keeps the time;

(c) analogue display means for displaying at least hours and minutes by means of hands and dial plate connected with said gear wheel train;

(d) said time keep means comprising a frequency divider circuit connected to said time reference generation signal source and an electro-mechanical time keep mechanism receiving an output signal from said frequency divider circuit and transmitting the driving signal to said analogue display means;

(e) electrical time keep means for receiving an output signal from said time keep means and for keeping a time information of at least hours and minutes from said frequency divider circuit;

(f) external alarm actuating means for providing an alarm time information of at least hours and minutes;

(g) an alarm memory circuit for receiving and storing the alarm time information provided by said external alarm actuating means;

(h) a coincidence detection circuit connected to said alarm memory circuit and to said electrical time keep means respectively, and receiving and comparing the alarm time information signal stored in said alarm memory circuit and the time information kept by said electrical time keep means for detecting a coincidence thereof so as to transmit an alarm signal;

(i) an alarm emitting device emitting an alarm by the alarm signal from said coincidence detection circuit;

(j) alarm digital display means connected to said alarm memory circuit and provided at a part of a display area of said analogue display means for digitally displaying the alarm time information stored in said alarm memory circuit; and (k) digital time display means connected through a first decoder driving circuit to said electrical time keep means and arranged on the display area of said analogue display means in addition to said alarm digital display means for displaying the kept time information of said electrical time keep means, and a second decoder driving circuit connected between said alarm memory circuit and said alarm digital display means.

7. The electronic timepiece according to claim 6 further comprising external operating means connected to said electro-mechanical time keep mechanism for correcting the time keep means so as to correct the kept time of said electrical time keep means.

8. The electronic timepiece according to claim 6 wherein said electrical time keep means comprises a minute counter, an hour counter and an a.m.-p.m. counter, and said alarm memory circuit comprises a minute memory circuit, an hour memory circuit and an a.m.-p.m. memory.

9. The electronic time piece according to claim 6 wherein said electro-mechanical time keep mechanism comprises a driving circuit and said gear wheel train, said electronic time piece further comprising a mechano-electric converter provided between said gear wheel train and said electrical time keep means.

10. An electronic timepiece comprising:

(a) a time reference signal generation source;

(b) time keep means for processing the time reference signal to synthesize a driving signal, said time keep means including a gear wheel train which keeps the time;

(c) analogue display means driven by the driving signal to display the time as an analogue hand display;

(d) electrical time keep means receiving an output signal from said time keep means receiving an output signal from said time keep means to keep the time information of at least hours and minutes;

said time keep means comprising a frequency divider circuit connected to said time reference signal generation source, and an electro-mechanical time keep mechanism comprising a driving circuit receiving an output signal from said frequency divider circuit, and said gear wheel train, said gear wheel train being connected between said driving circuit and said analogue display means, said electrical time keep means converting the time information from said time keep means into an electrical signal;

(e) digital time display means for digitally displaying the time information kept by said electrical time keep means through a first decoder driving dircuit;

(f) external alarm operating means for providing an alarm time information;

(g) an alarm memory circuit receiving and storing the alarm time information provided by said alarm operating means;

(h) alarm digital display means for digitally displaying the alarm time information stored in the alarm memory circuit through a second decoder driving circuit; and (i) an external operating means connected to said electro-mechanical time keep mechanism for correcting the time information displayed on said digital time display means by correcting the kept time of said electrical time keep means.

11. The electronic timepiece according to claim 10 further comprising a coincidence detection circuit connected between said electrical time keep means and said alarm memory circuit and detecting the coincidence between the time information kept by said electrical time keep means and the alarm time information stored by said alarm memory circuit, and an alarm emitting device generating an alarm by the alarm signal from said coincidence detection circuit.

12. The electronic timepiece according to claim 10 wherein said time keep means comprises an electro-mechanical time keep mechanism receiving the output signal from said frequency division circuit so as to transmit the driving signal to said analogue display means, and said electrical time keep means keeps time information from said frequency divider circuit.

* * * * *